US006412713B2

(12) United States Patent
Okajima et al.

(10) Patent No.: US 6,412,713 B2
(45) Date of Patent: Jul. 2, 2002

(54) FUEL INJECTION APPARATUS

(75) Inventors: Masahiro Okajima, Kariya; Satoru Asai, Takahama, both of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/729,992

(22) Filed: Dec. 6, 2000

(30) Foreign Application Priority Data

Dec. 7, 1999 (JP) ..... 11-347555
Mar. 15, 2000 (JP) ..... 2000-072375

(51) Int. Cl.[7] ..... B05B 1/30; F02M 51/00

(52) U.S. Cl. ..... 239/585.1; 239/585.4; 239/585.5

(58) Field of Search ..... 239/585.1, 585.2, 239/585.3, 585.4, 585.5, 88; 251/129.1, 129.9, 129.18, 129.21; 335/256

(56) References Cited

U.S. PATENT DOCUMENTS 4,361,309 A * 11/1982 Sogabe ..... 251/137
4,883,025 A * 11/1989 Richeson, Jr. ..... 123/90.11
4,964,571 A * 10/1990 Taue et al. ..... 239/88
4,972,996 A * 11/1990 Cerny ..... 239/585
5,421,521 A * 6/1995 Gibson et al. ..... 239/585.4
5,494,219 A * 2/1996 Maley et al. ..... 239/88
5,996,910 A 12/1999 Takeda et al.
6,036,120 A * 3/2000 Varble et al. ..... 239/585.3

FOREIGN PATENT DOCUMENTS

JP 6-129323 5/1994
JP 0 629 711 A1 * 6/1994
JP 7-239050 9/1995

* cited by examiner

*Primary Examiner*—William C. Doerrler
*Assistant Examiner*—Davis Hwu
(74) *Attorney, Agent, or Firm*—Nixon & Vanderhye PC

(57) ABSTRACT

In an electromagnetic fuel injector, when an opening valve pulse is turned ON by a command from an ECU, a first coil is energized and a first fixed core attracts a moving core and unseats a valve member from a valve seat to open a valve of the fuel injector. A time Tx before the opening valve pulse becomes OFF, a closing valve pulse is turned ON, whereby a second coil is energized and a second fixed core attracts the moving core toward a valve closing direction. As a result, after the valve starts to close, the urging force in the valve closing direction increases rapidly, the time delay from the start of valve closing to the end is shortened, and the valve closing responsiveness improves.

18 Claims, 9 Drawing Sheets

FUEL INJECTION APPARATUS

CROSS REFERENCE TO RELATED APPLICATION

This application is based on and incorporates herein by reference Japanese Patent Application Nos. Hei. 11-347555 filed on Dec. 7, 1999, and 2000-72375 filed on Mar. 15, 2000.

BACKGROUND OF THE INVENTION

1. Field of the Invention

The present invention relate to an electromagnetic fuel injection apparatus injecting an optimum fuel amount in accordance with a driving state of an internal combustion engine.

2. Description of the Related Art

There have been fuel injectors wherein an electromagnetic valve controls an injected quantity of fuel by seating on a valve seat and unseating from the valve seat a nozzle needle constituting a valve member.

FIG. 7 is a characteristic chart showing the lift of the nozzle needle with respect to a driving pulse driving a coil in a fuel injector of this kind. After the driving pulse becomes ON, the nozzle needle reaches full lift at a certain time delay To from the start of lifting, and after the driving pulse becomes OFF, the nozzle needle reaches zero lift, i.e. seats on the valve seat, after a certain time delay Tc from the start of closing.

The quantity of fuel injected by this fuel injector is controlled by way of the ON time of the driving pulse. To reduce fuel consumption at times of low load, such as when the engine is idling, it is desirable for the minimum injection quantity to be made as small as possible.

FIG. 8 shows the injection capability of a fuel injector by the relationship between the ON time Tq of the driving pulse and the fuel injection quantity. Since the opening area of a nozzle hole is not constant for the period from when the nozzle needle starts to lift until full lift, when Tq is small and the nozzle needle does not reach full lift, the fuel injection quantity is not linear with respect to the ON time. In this region of nonlinearity, exact control of the fuel injection quantity is very difficult, and there is the problem that injection becomes unstable and engine running does not stabilize.

To obtain linearity even at small fuel injection quantities, it is necessary to raise the opening and closing responsiveness of the electromagnetic valve and shorten the time delays which occur on valve opening and valve closing. Fuel injectors which have a driving circuit incorporating a capacitor for accumulating a charge and passing a large current in order to raise the opening and closing responsiveness of the electromagnetic valve are known, but because these driving circuits are very expensive they make it impossible to reduce the cost of the fuel injection system.

A fuel injector in which two driving circuits each having a solenoid are provided to improve the valve opening responsiveness, as shown in JP-A-6-129323, is also known, but even with this fuel injector, because the responsiveness on valve closing does not improve, it has not always been possible to realize a desired minimum injection quantity.

Another prior document relating to an electromagnetic fuel injector is JP-A-7-239050. In this, technology is disclosed wherein a fuel injector (electromagnetic fluid control valve) for injecting fuel into an internal combustion engine has an opening solenoid and a closing solenoid; currents are passed through the respective solenoids at predetermined opening and closing times of a valve member (opening and closing valve) of the fuel injector; and opening and closing is controlled by attracting forces produced at those times.

However, in the fuel injector of JP-A-7-239050, as a result of a spring force and an attracting force acting simultaneously during closing of the fuel injection valve, the impact speed of the valve member is high and its operating noise is loud. This also lowers the durability of the valve seat part. To deal with this, it is conceivable to suppress the operating noise by turning off the current to the closing solenoid immediately before the valve of the fuel injector closes; however, with this kind of control there has been the problem that the valve member tends to bounce back open after the fuel injection finishes, and a secondary injection, supplying excess fuel, takes place.

SUMMARY OF THE INVENTION

An object of the present invention to provide a fuel injector which is cheap and has a high valve closing responsiveness.

A fuel injector provided by the invention to achieve this object and other objects comprises a first coil for, when energized by an electric current, magnetizing a first fixed core and thereby attracting a moving core integral with a valve member toward a valve opening direction, and a second coil for, when energized by an electric current, magnetizing a second fixed core and thereby attracting the moving core toward a valve closing direction. As a result, even when a driving circuit does not have a capacitor, like as a battery voltage driving circuit, the valve closing responsiveness of the fuel injector is improved.

Also, the energizing of the second coil is started before the end of energizing of the first coil for holding the valve open. Thus, the attracting force toward the valve closing direction acting on the moving core during closing of the valve becomes large, and the valve closing responsiveness improves.

Further, in a valve closing stroke, energizing of the second coil is ended before the valve member seats on the valve seat. Thus, the moving speed of the valve member just before seating decreases, and operating noise generated by the valve member colliding with the valve seat while the valve closes is reduced.

BRIEF DESCRIPTION OF THE DRAWINGS

Additional objects and advantages of the present invention will be more readily apparent from the following detailed description of preferred embodiments thereof when taken together with the accompanying drawings, in which.

DETAILED DESCRIPTION OF THE PREFERRED EMBODIMENTS

Preferred embodiments of practicing the present invention will be described with reference to the drawings.

First Embodiment

Figure 1:
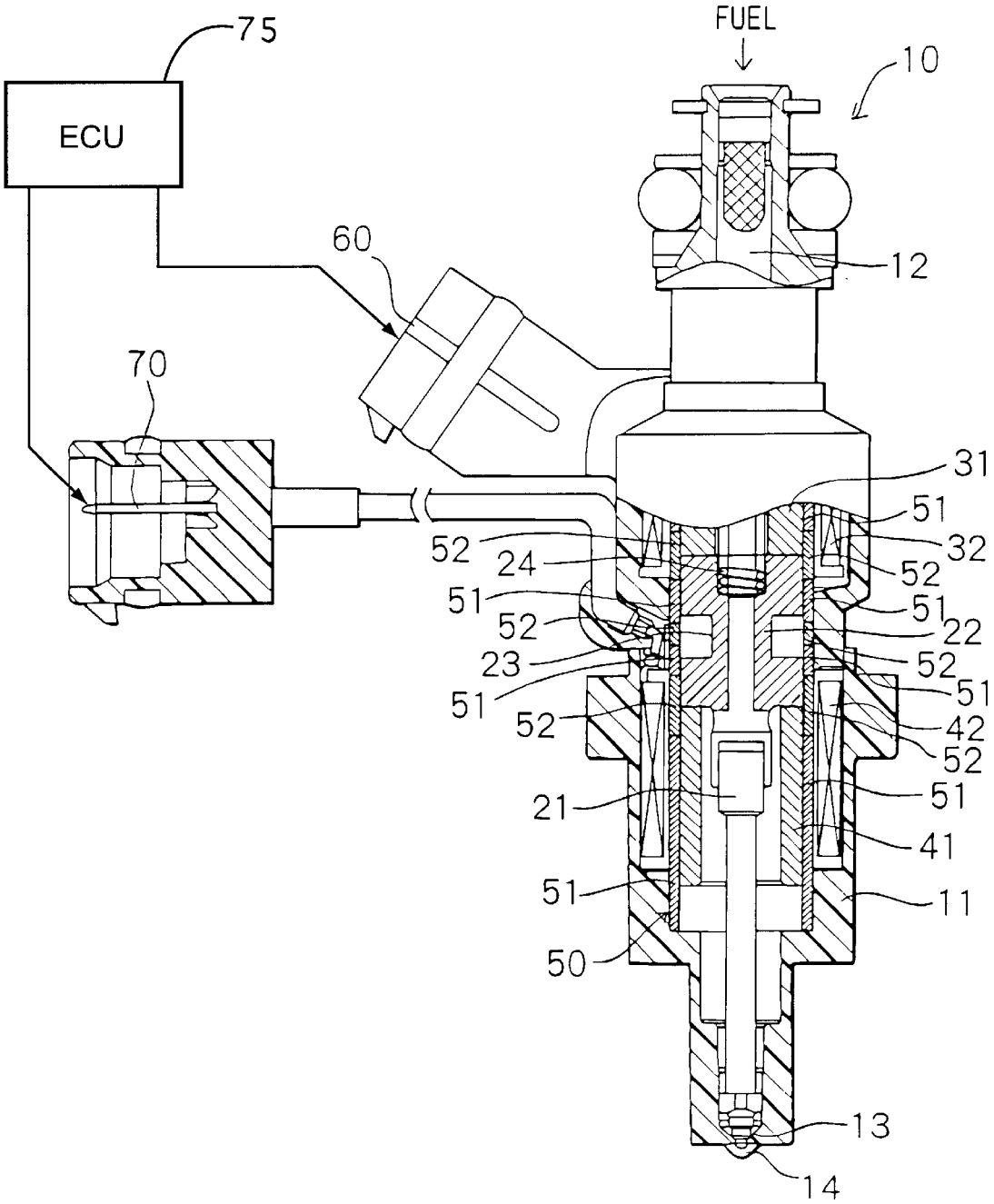
FIG. 1 is a cross-sectional view showing an electromagnetic fuel injector according to the present invention (first embodiment)

FIG. 1 is a cross-sectional view showing an injector 10 as a fuel injection apparatus in the first embodiment of the present invention.

High-pressure fuel supplied from a high-pressure fuel pump (not illustrated) to a common rail is accumulated to a constant high pressure in an accumulator inside the common rail, and is supplied to an injector 10 provided at each cylinder.

A fuel passage 12 is formed inside a cylindrical injector body 11, and a nozzle needle 21 forming a valve member, and a moving core 22 movable in an axial direction integrally with the nozzle needle 21 and made of a magnetic material are installed in the fuel passage 12. The tip of the nozzle needle 21 opens a fuel injection hole 14 by leaving a valve seat 13 of the injector body 11, and closes the injection hole 14 by seating on the valve seat 13.

A first fixed core 31 is disposed on the opposite side of the moving core 22 from the nozzle hole. When a first coil 32 is energized, the first fixed core 31 is magnetized and attracts the moving core 22 to open the valve. A second fixed core 41 is disposed on the same side of the moving core 22 as the nozzle hole. When a second coil 42 is energized, the second fixed core 41 is magnetized and attracts the moving core 22 to close the valve.

A coil spring 24 for urging the moving core 22 and the nozzle needle 21 toward the valve closing direction is mounted on one side of the moving core 22.

A tubular housing 50 formed so as to surround the moving core 22, the first fixed core 31 and the second fixed core 41 includes magnetic parts 51 made of a magnetic material and nonmagnetic parts 52 made of a nonmagnetic material lined up alternately in the axial direction. The nonmagnetic parts 52 are positioned where the moving core 22 and the first fixed core 31 face each other and where the moving core 22 and the second fixed core 41 face each other. Thus, the flows in the axial direction of the magnetic fluxes flowing around the facing parts of the moving core 22 and the fixed cores 31, 41 when the coils 41, 42 are energized, which contribute to the forces with which the fixed cores 31, 41 attract the moving core 22, become larger, and the attracting forces increase and the responsiveness of valve opening and valve closing improves.

An annular groove 23 is provided in an axially central position in the outer periphery of the moving core 22. The nonmagnetic part 52 of the tubular housing 50 faces the annular groove 23 of the moving core 22, so that flows of magnetic flux at one side of the moving core 22, which is attracted by the first fixed core 31, and the other side of the moving core 22, which is attracted by the second fixed core 41, are made independent, thereby reducing their influences on each other.

Figure 2:
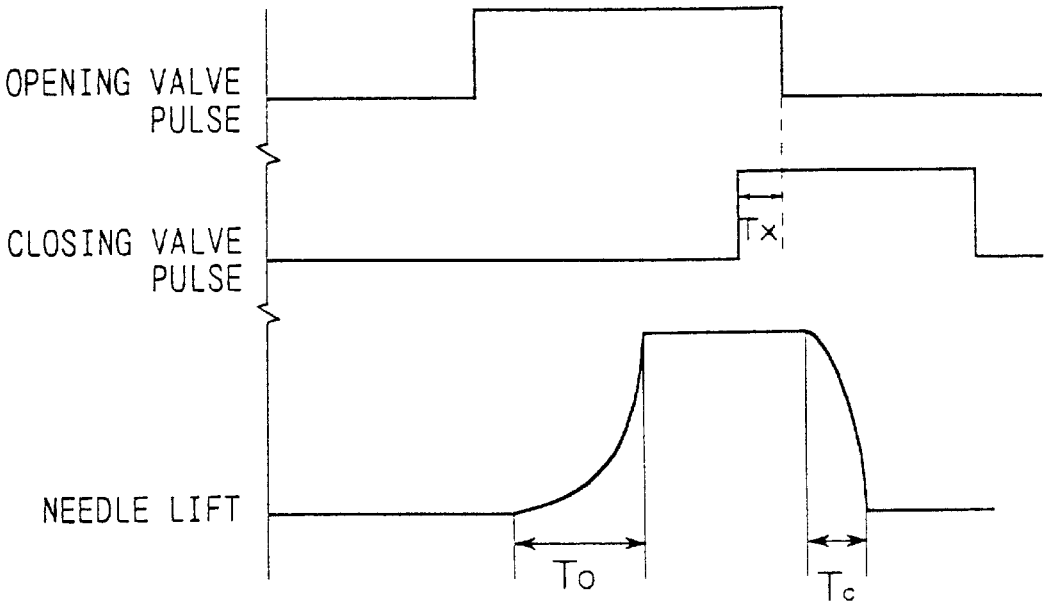
FIG. 2 is a time chart showing valve driving pulses and lift of a nozzle needle (first embodiment)

The operation of the injector 10 will be explained. FIG. 2 is a time chart showing valve driving pulses and lift of the nozzle needle 21 in the first embodiment of the present invention.

While the electric current to the first coil 32 is OFF, the moving core 22 and the nozzle needle 21 are urged toward the valve closing direction by the urging force of the coil spring 24, and the tip of the nozzle needle 21 is seated on the valve seat 13 and fuel is not injected through the injection hole 14.

When, on the basis of a command from an ECU (Electronic Control Unit) 75 controlling fuel injection in accordance with the running state of the internal combustion engine, an opening valve pulse becomes ON, a voltage from a battery (not illustrated) is impressed on a terminal 60 electrically connected to the first coil 32, and an electric current is supplied into the first coil 32. As a result, the first fixed core 31 generates a valve-opening attracting force attracting the moving core 22 toward the valve opening direction, the nozzle needle 21 moves toward the valve opening direction and leaves the valve seat 13, and the injection hole 14 opens to inject the fuel.

After a predetermined delay time To from a timing when the nozzle needle 21 starts to move toward the valve opening direction has passed, the nozzle needle 21 reaches full lift. Thus, while the opening valve pulse is ON, the nozzle needle 21 is held at full lift.

When the opening valve pulse becomes OFF, the electric current supply to the first coil 32 is shut off and the valve-opening attracting force decreases. When the valve-opening attracting force becomes smaller than the urging force of the coil spring 24 toward the valve closing direction, the nozzle needle 21 starts to move toward the valve closing direction. After a predetermined delay time Tc from when the nozzle needle 21 starts to move toward the valve closing direction, the needle lift becomes zero and the tip of the nozzle needle 21 contacts the valve seat 13 and the fuel injection stops.

Figure 7:
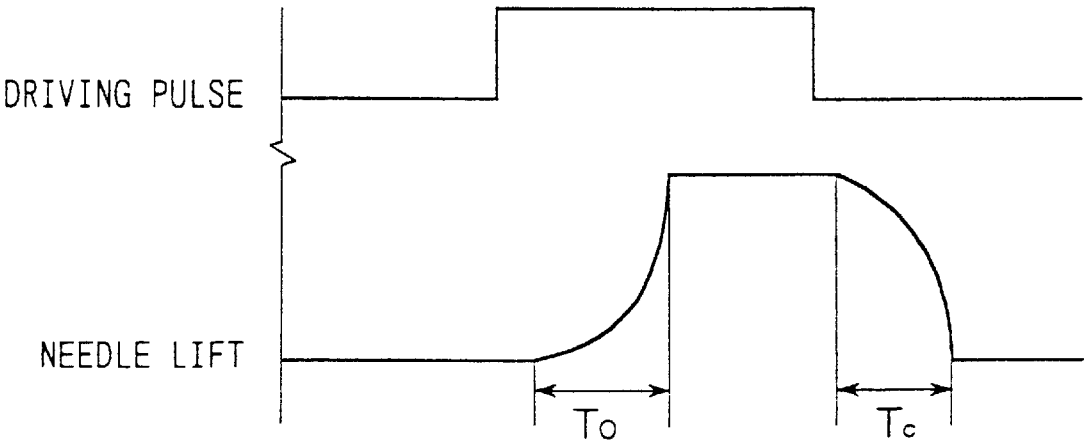
FIG. 7 is a time chart showing a valve driving pulse and needle lift in a fuel injector of related art.

In the present embodiment, a time Tx before the opening valve pulse becomes OFF, on the basis of a command from the ECU 75 the closing valve pulse is turned ON, an electric voltage is impressed on a terminal 70 electrically connected to the second coil 42, and an electric current is supplied into the second coil 42. As a result, the second fixed core 41 generates a valve-closing attracting force attracting the moving core 22 toward the valve closing direction; the delay time Tc from the start of valve closing to the end of valve closing is shorter than in the prior art shown in FIG. 7, and the valve closing responsiveness improves.

A method for setting the timing at which the closing valve pulse is turned ON in the present embodiment will be described.

Figure 3:
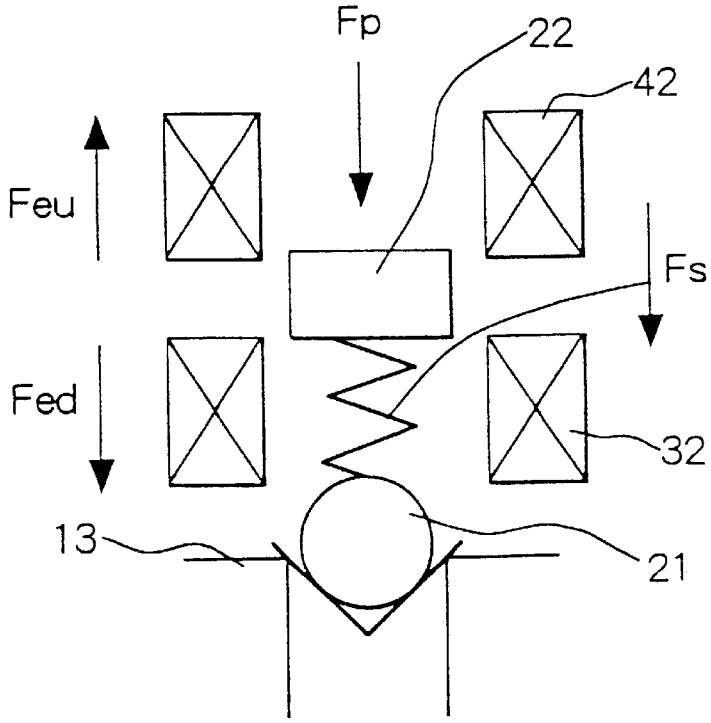
FIG. 3 is a schematic view illustrating forces acting on a moving core (first embodiment)

FIG. 3 is a schematic view illustrating forces acting on the moving core 22 toward the valve opening direction and the valve closing direction in the present first embodiment of the present invention. Fp is the fuel pressure acting on the moving core 22 toward the valve closing direction, Fs is the urging force of the coil spring 24 toward the valve closing direction, Feu is the attracting force acting on the moving core 22 toward the valve opening direction when the first coil 32 is energized, and Fed is. the attracting force acting on the moving core 22 toward the valve closing direction when the second coil 42 is energized. Here, the valve closing operation starts when:

$$Feu-(Fp+Fs)\leqq Fed \quad (1)$$

Therefore, when the closing valve pulse is turned ON at a timing a time Tx before the opening valve pulse becomes OFF so that at the timing when the opening valve pulse becomes OFF, $$Feu-(Fp+Fs)=Fed \quad (2)$$

Thereby, the attracting force of the second fixed core 41 in the valve closing direction increases rapidly after the opening valve pulse becomes OFF, and the responsiveness on valve closing is improved without the valve opening operation being influenced.

Figure 4:
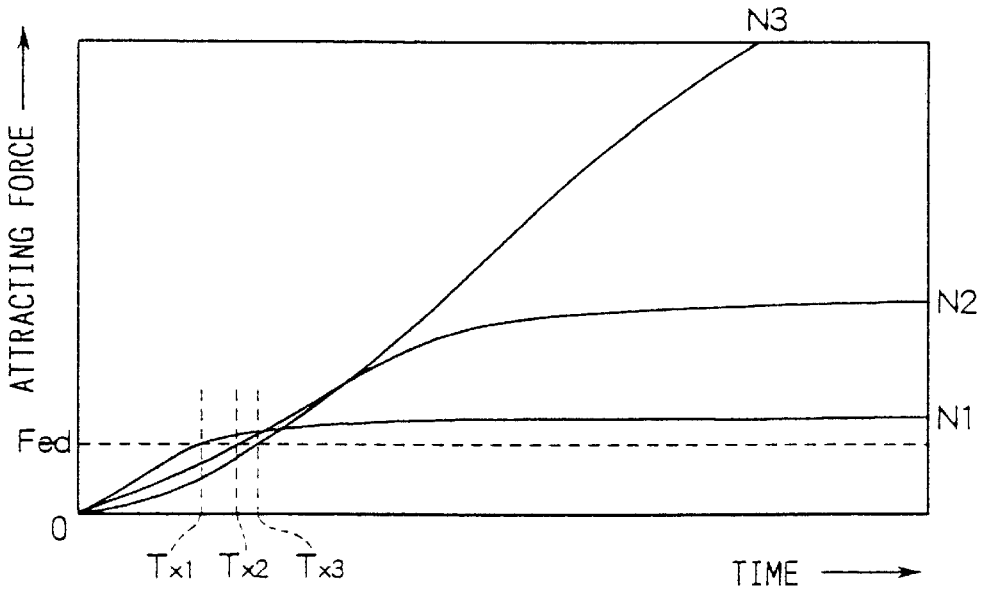
FIG. 4 is a characteristic chart showing change of an attracting force for different numbers of windings of a coil (first embodiment)

FIG. 4 is a characteristic chart showing change of the valve-closing attracting force of the second fixed core 41 from the start of the energizing in the first embodiment of the present invention, for each of three different numbers of windings (N1, N2, N3) of the second coil 42. Here, N1<N2<N3. The final attracting force becomes larger as the number of windings increases.

Figure 8:
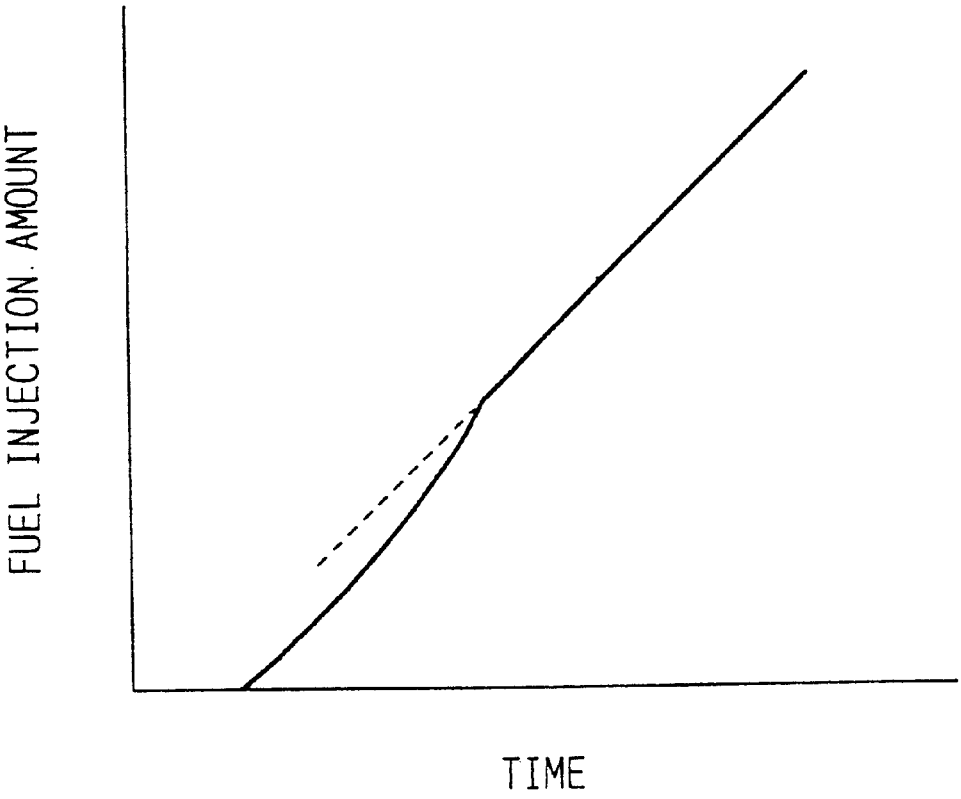
FIG. 8 PRIOR ART
FIG. 8 is a characteristic chart showing a relationship between driving pulse ON time and fuel injection amount in an ordinary fuel injector.

For example, if Fed which satisfies the above expression (2) at the point when the opening valve pulse becomes OFF is the value denoted by a broken line in FIG. 4, when the number of windings of the second coil 42 is N1, if the closing valve pulse is turned ON a time Tx1 before the opening valve pulse becomes OFF, the above expression (2) holds at the point when the opening valve pulse becomes OFF. Similarly, when the number of windings is N2 or N3, the closing valve pulse is turned ON at Tx2 or Tx3, respectively. When the number of windings of the coil is selected so that the gradient of the valve-closing attracting force at the point where it rises above this Fed value is large, valve closing starts rapidly after the opening valve pulse becomes OFF, thereby improving the valve closing responsiveness. Thus, the region, where the coil energizing time and the fuel injection amount shown in FIG. 8 are linear, extends to shorter energizing time side, and it becomes easy to perform exact control even when the fuel injection amount from valve opening to valve closing is made small. In the present embodiment, the timing at which above expression (2) is satisfied is selected as the timing at which the closing valve pulse is turned ON. However, as long as it is selected so that a desired minimum fuel injection amount is attained in the range where there is linearity, the closing valve pulse may be set to become ON at some other timings.

Second Embodiment

Figure 5:
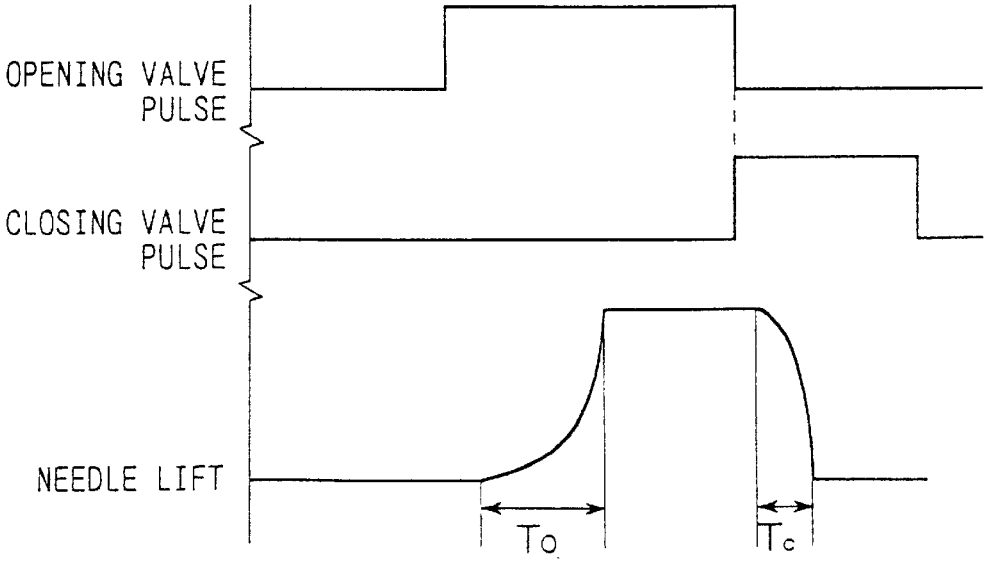
FIG. 5 is a time chart showing valve driving pulses and lift of a nozzle needle (second embodiment)

FIG. 5 is a time chart showing opening and closing valve pulses and lift of the nozzle needle 21 in a second embodiment of the present invention. The construction of the injector 10 is the same as in the first embodiment and therefore will not be described again here.

In the second embodiment, the closing valve pulse is turned ON simultaneously with the opening valve pulse becoming OFF. Thus, there is no overlapping of the period during which the first coil 32 is energized and an attracting force acts on the moving core 22 toward the valve opening direction and the period during which the second coil 42 is energized and an attracting force acts on the moving core 22 toward the valve closing direction. In this way, it is possible to increase the attracting force toward the valve closing direction after the start of valve closing, and to improve the valve closing responsiveness of the injector 10 while preventing the valve opening response of the injector 10 being delayed by the attraction of the second fixed core 41 toward the valve closing direction.

Third Embodiment

Figure 6:
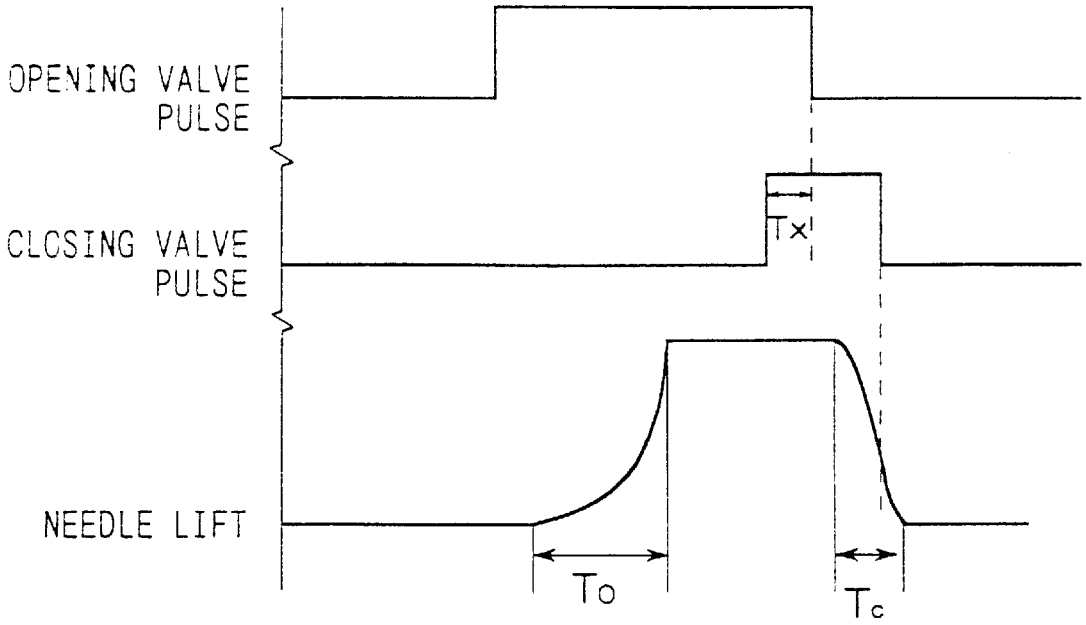
FIG. 6 is a time chart showing valve driving pulses and lift of a nozzle needle (third embodiment)

FIG. 6 is a time chart showing opening and closing valve pulses and lift of the nozzle needle 21 in the third embodiment of the present invention. The construction of the injector 10 is the same as in the first and second embodiments and therefore will not be described again here.

In the third embodiment, as in the first embodiment, the closing valve pulse is turned ON a time Tx before the opening valve pulse becomes OFF. By this, when the opening valve pulse becomes OFF and the valve opening operation starts, a valve-closing attracting force of the second fixed core 41 attracting the moving core 22 is generated and the valve closing responsiveness improves.

Further, in the present embodiment, the closing valve pulse is turned OFF before the lift of the nozzle needle 21 becomes zero and the nozzle needle 21 seats on the valve seat 13. As a result, during the valve closing operation, the urging force toward the valve closing direction decreases before the nozzle needle 21 contacts the valve seat 13, and operating noise of valve closing made by the nozzle needle 21 colliding with the valve seat 13 is reduced.

As above-described embodiments, in the present invention, since it is possible to improve the responsiveness of an injector without using an expensive driving circuit having a capacitor, the manufacturing cost thereof is reduced.

Fourth Embodiment

Figure 9:
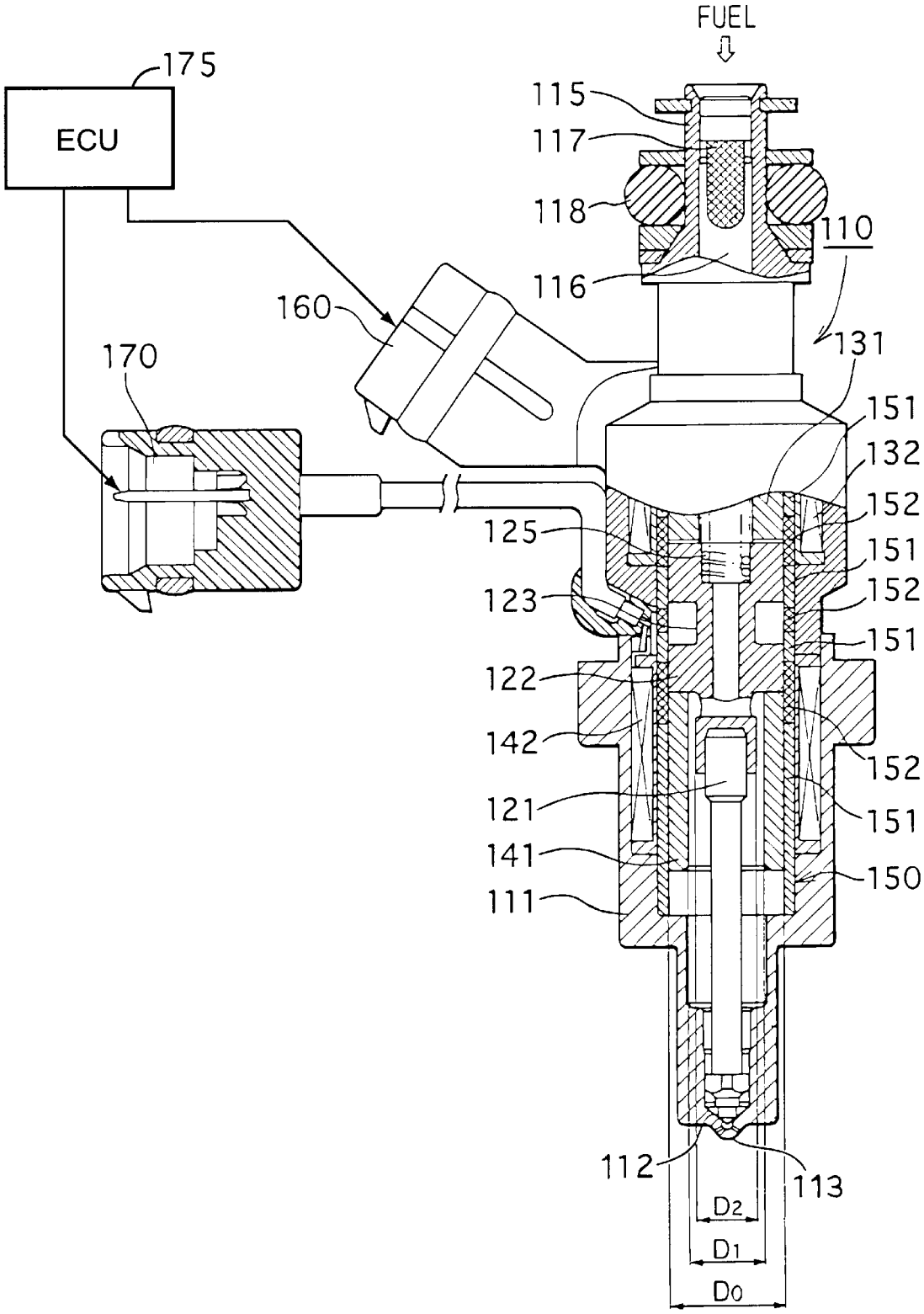
FIG. 9 is a cross-sectional view of an electromagnetic fuel injector according to the present invention (fourth embodiment)

FIG. 9 is a cross-sectional view showing an injector (fuel injection valve) to which an electromagnetic fuel injection apparatus of the fourth embodiment of the present invention is applied.

In FIG. 9, high-pressure fuel supplied from a high-pressure fuel pump (not illustrated) to a common rail is accumulated to a constant high pressure in an accumulator inside the common rail, and is supplied to an injector 110 for each cylinder. The injector 110 is mainly includes a cylindrical body 111 and a fuel connector 115 joined together in the axial direction. A tubular housing 150 is fitted inside the injector body 11 and the fuel connector 115 of the injector 110. A moving core 122 made of a strongly magnetic material with a nozzle needle 121 as a valve member integrally fitted thereto is accommodated in the tubular housing 150, movably in the axial direction.

The tip of the nozzle needle 121 opens a nozzle hole 113 formed in the tip of the body 111 by leaving a valve seat 112 formed inside the tip of the body 111, and closes the nozzle hole 113 by seating on the valve seat 112. By this operation, an amount of fuel injected through the nozzle hole 113 is set. The fuel is introduced through a filter 117 and a fuel passage 116 in the fuel connector 115. The accumulator inside the common rail is liquid-tightly sealed and connected to the fuel connector 115 of the injector 110 by an O-ring 118.

A first fixed core 131 is fit and fixed in the tubular housing 150, while facing a fuel introduction side end face of the moving core 122. A first coil 132 is mounted around this first fixed core 131, and when the first coil 132 is energized with an electrical current by way of a terminal 160, the first fixed core 131 is magnetized and attracts the moving core 122 toward a valve opening direction. A second fixed core 141 is fit and fixed in the tubular housing 150, facing the nozzle hole 113 side end face of the moving core 122. A second coil 142 is mounted around this second fixed core 141, and when the second coil 142 is energized with an electrical current by way of a terminal 170, the second fixed core 141 is magnetized and attracts the moving core 122 toward a valve closing direction. A coil spring 125, for urging the nozzle needle 121 toward the valve closing direction through the moving core 122, is mounted at the fuel introduction side end of the moving core 122. A wiring from the terminal 160 is liquid-tightly connected and sealed to the first coil 132 by synthetic resin, and a wiring from the terminal 170 is connected and sealed to the second coil 142 similarly.

As described above, the tubular housing 150 surrounds the moving core 122, the first fixed core 131 and the second fixed core 141. The tubular housing 150 is made of a strongly magnetic material. However, induction hardening is carried out at a necessary portion, non-magnetic parts are formed therein. Magnetic parts 151 and nonmagnetic parts 152 are formed in a ring, and line up alternately in the axial direction. That is, the parts of the tubular housing 150 where the moving core 122 and the first fixed core 131 face each other and where the moving core 122 and the second fixed core 141 face each other are made nonmagnetic parts 152. Thus, in the magnetic fluxes flowing around the facing parts of the moving core 122 and the first and second fixed cores 131, 141 when the first and second coils 141, 142 are energized, the flows thereof in the axial direction, which contribute to the forces with which the first and second fixed cores 131, 141 attract the moving core 122, become larger, so that the attracting forces increase and the responsiveness of valve opening and valve closing improves.

An annular groove 123 is provided in an axially central position in the outside of the moving core 122, and another nonmagnetic part 152 of the tubular housing 150 faces the annular groove 123 of the moving core 122. Thus, flows of magnetic flux at the fuel introduction side end of the moving core 122, which is attracted by the first fixed core 131, and the nozzle hole side end of the moving core 122, which is attracted by the second fixed core 141, are made independently from each other, and their influences on each other are reduced.

Figure 10A:
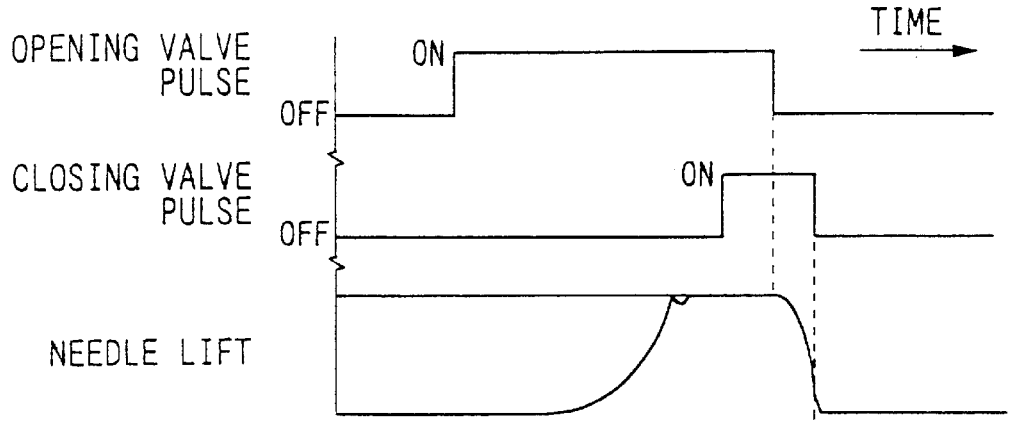
FIGS. 10A–10C are time charts comparing valve driving pulses and needle lift in the injector in FIG. 9 with related art (fourth embodiment)
Figure 10B:
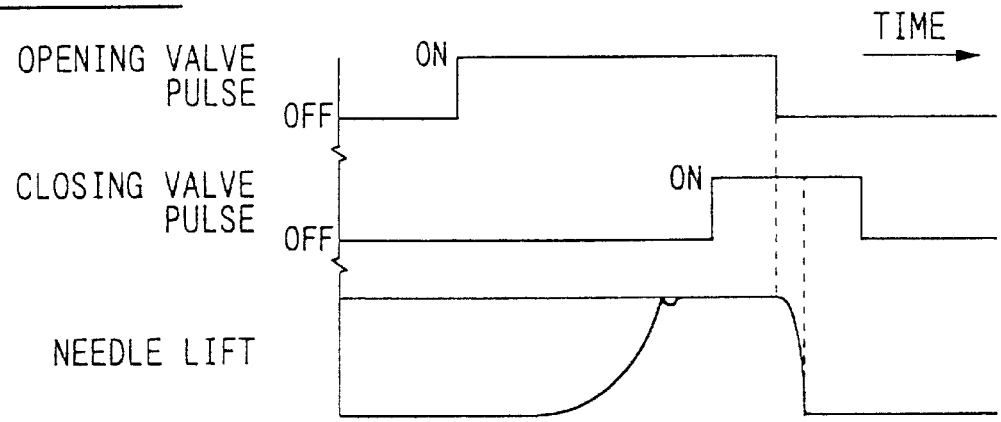
FIG. 10B PRIOR ART
Figure 10C:
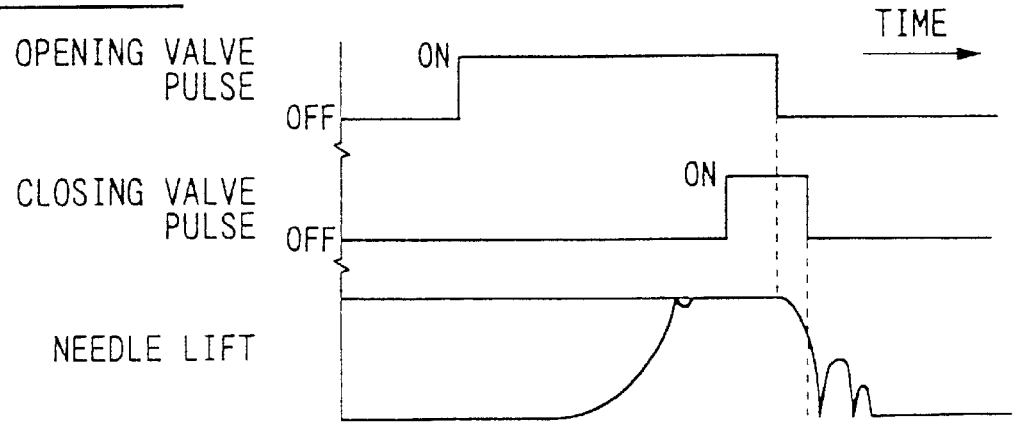
FIG. 10C PRIOR ART

The operation of the injector 110 in the present embodiment will be explained with reference to FIGS. 9 and 10A–10C. Here, FIG. 10A is a time chart showing a needle lift at driving pulse timing (opening and closing valve pulses) in the injector 110. FIGS. 10B and 10C are time charts showing, for comparison, needle lifts at conventional driving pulse timing in an injector 110.

In FIG. 9, while the first coil 132 is not energized, the moving core 122 and the nozzle needle 121 are urged toward the valve closing direction by the urging force of the coil spring 125. Thus, the tip of the nozzle needle 121 keeps seating on the valve seat 112, and fuel is not injected through the nozzle hole 113 formed in the tip of the body 111.

When, on the basis of a command from an ECU 175 controlling the fuel injection amount of the injector 110 in accordance with the running state of the internal combustion engine, an opening valve pulse becomes ON, as shown in FIG. 10A, an electric voltage from a battery (not illustrated) is impressed on the terminal 160 electrically connected to the first coil 132, and an electric current is supplied into the first coil 132. The first fixed core 131 generates a valve-opening attracting force attracting the moving core 122 toward the valve opening direction. When this attracting force toward the valve opening direction overcomes the urging force of the coil spring 125, the tip of the nozzle needle 121 integrated with the moving core 122 moves in toward the valve opening direction and leaves the valve seat 112 and the nozzle hole 113 opens to start fuel injection.

After a predetermined delay time from when the tip of the nozzle needle 121 starts moving toward the valve opening direction, the nozzle needle 121 reaches full lift. As long as the opening valve pulse is ON, the nozzle needle 121 is held at full lift. When the opening valve pulse becomes OFF and the electric current is not supplied into the first coil 132, the valve-opening attracting force gradually decreases. At least 0.2 ms before this valve-opening attracting force is turned OFF, as shown in FIG. 10A, a command of the ECU turns the closing valve pulse ON. Thereby, the battery voltage is impressed on the terminal 170 electrically connected to the second coil 142, and the second coil 142 is energized.

As a result, the second fixed core 141 generates an attracting force attracting the moving core 122. When this 20 valve-closing attracting force and the urging force of the coil spring 125 overcome the attracting force of the first fixed core 131 toward the valve opening direction, the tip of the nozzle needle 121 integrated with the moving core 122 starts to move toward the valve closing direction. Then, 25 after a predetermined time from when the nozzle needle 121 starts to move toward the valve closing direction, the needle lift becomes zero and the tip of the nozzle needle 121 seats on the valve seat 112 and fuel injection through the nozzle hole part 113 is stopped.

Further, as shown in FIG. 10A, the closing valve pulse is turned OFF just before the tip of the nozzle needle 121 seats on the valve seat 112. Thus, the time delay from the start of closing to the end of closing while the tip of the nozzle needle 121 seats on the valve seat 112 is reduced, and also the collision speed at which the tip of the nozzle needle 121 collides with the valve seat 112 is kept down. As a result, a minimum fuel injection amount Qmin is obtained, the valve closing responsiveness is improved, and operating noise is reduced. Here, as long as the minimum fuel injection amount Qmin is obtained, the closing valve pulse may alternatively be kept OFF.

Contrary to this, in the time chart of FIG. 10B, although the opening valve pulse is turned ON and OFF with the same timing as in FIG. 10A, the closing valve pulse is still ON when the needle lift becomes zero and the tip of the nozzle needle 121 seats on the valve seat 112, thereby causing a loud operating noise. Further, in the time chart shown in FIG. 10C, although the closing valve pulse is turned ON and OFF with the same timing as in FIG. 10A, when there is no oil damper effect, bounce occurs, thereby causing a secondary injection through the nozzle hole 113.

Figure 11:
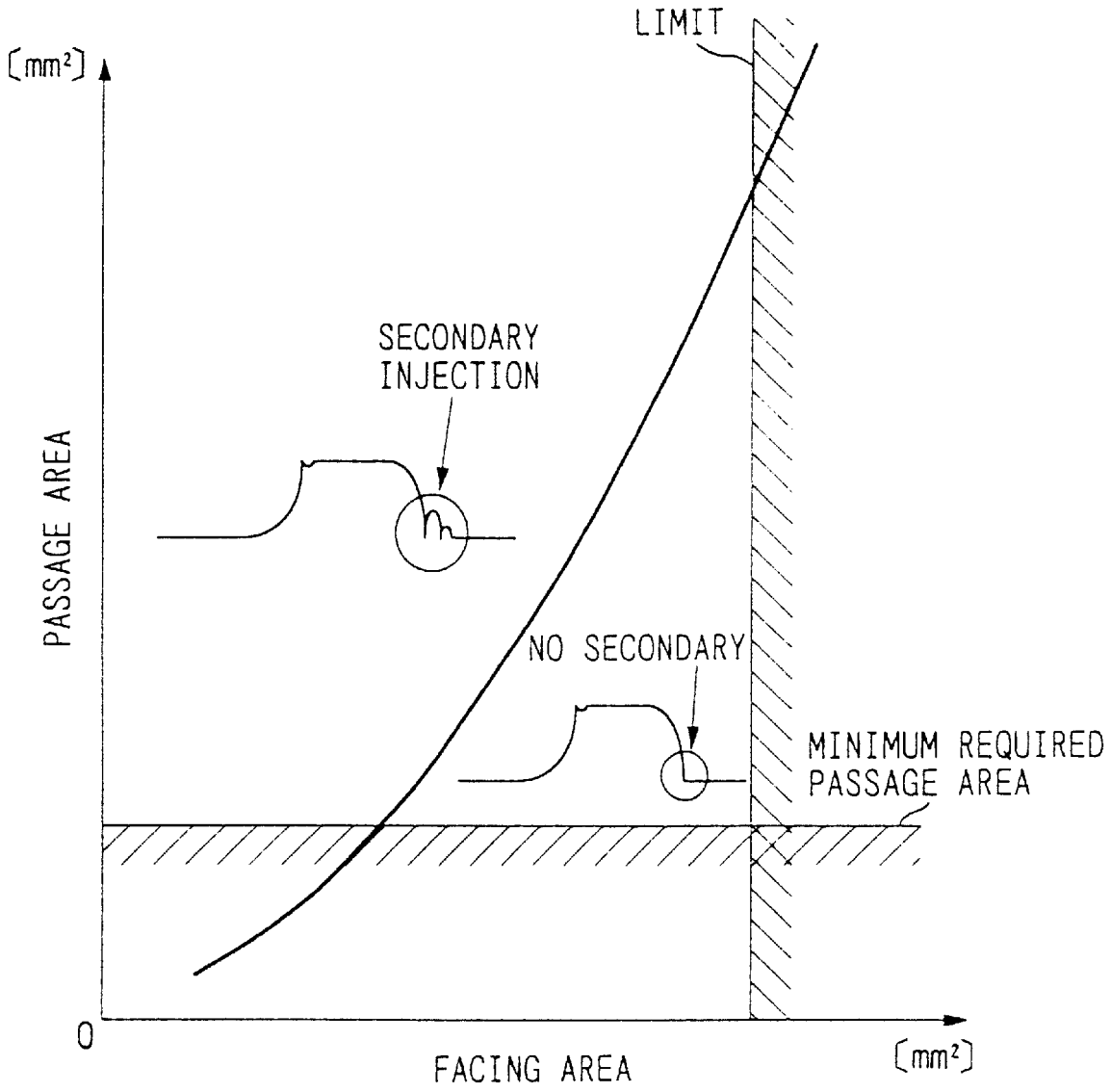
FIG. 11 is a graph showing a relationship between facing area and fuel passage area capable of suppressing secondary injection in the injector in FIG. 9 (fourth embodiment)

To deal with this kind of secondary injection, in the injector 110 of the present embodiment, the relationship between the facing area of the moving core 122 and the second fixed core 141 shown in FIG. 9, $\{(\pi/4)\times(D0^2-D1^2)\}$ $mm^2$, and the fuel passage area downstream of that, $\{(\pi/4)\times(D1^2-D2^2)\}$ $mm^2$, is set in a region such that a secondary injection does not arise. As shown in the graph of FIG. 11, the region is denoted by the roughly triangular shape which is bounded by a necessary minimum flow passage area, a limit imposed by mounting to the internal combustion engine, and a thick secondary curve. Here, the necessary minimum flow passage area is the flow passage area formed on the downstream side of the facing part necessary for attaining a fuel injection amount. When, in a theoretical equation based on Bernoulli's theorem, the injection rate is written Qdot, the flow coefficient $\mu$, the injection pressure P and the fuel density $\rho$, this necessary minimum flow passage area A is expressed by the following expression (3) and is 2 $mm^2$, for example.

$$A=Q\text{dot}/\{\mu(2P/r)^{1/2}\} \quad (3)$$

Here, the internal combustion engine mounting limit is determined by the external shape of the injector capable of being installed in each cylinder of the internal combustion engine. By this, fuel, pushed back by the moving core 122 facing the second fixed core 141 in the valve closing direction in which the tip of the nozzle needle 121 seats on the valve seat 112, passes through a narrow part between the moving core 122 and the second fixed core 141 and is fed out to the nozzle hole 113 in a compressed state, thereby obtaining an oil damper effect. Thus, no bounce occurs when the tip of the nozzle needle 121 seats on the valve seat 112, and as a result the secondary injection is suppressed.

Figure 12:
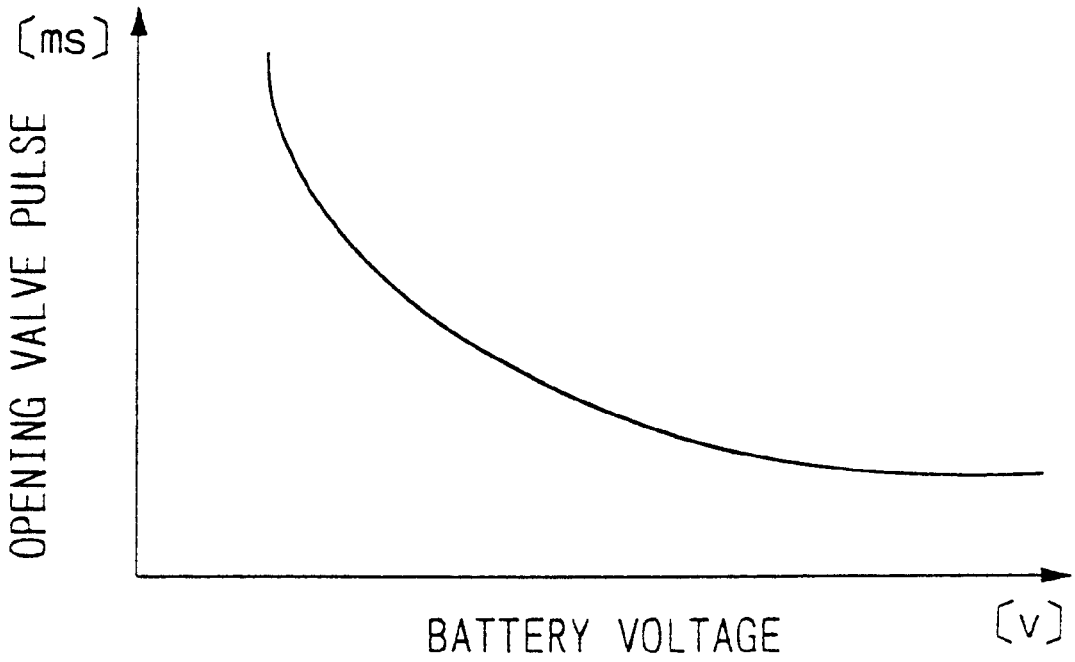
FIG. 12 is a graph showing a relationship between battery voltage and opening valve pulse for fulfilling a minimum fuel injection amount in the injector in FIG. 9 (fourth embodiment).

As described above, in the injector 110 of the present embodiment, when the opening valve pulse (ms) from the ECU becomes ON, the battery voltage (V: volts) is impressed on the first coil 132 through the terminal 160 and an attracting force for attracting the moving core 122 is generated by the first fixed core 131. Since the attracting force varies in accordance with a fluctuation of the battery voltage, as shown by the secondary curve graph in FIG. 12, the opening valve pulse is set to become longer as the battery voltage falls. This graph is pre-stored in the ECU in accordance with factors of compatibility between the internal combustion engine and the injector 110 and so on. As a result, in the injector 110 of the present embodiment, there is no need a driving circuit incorporating a capacitor, and the cost of the system is reduced.

In this way, the electromagnetic fuel injector 110 of the present embodiment has a nozzle needle 121 forming a valve member for opening and closing a nozzle hole 113 by leaving a valve seat 112 and seating on the valve seat 112; a moving core 122 formed integrally with the nozzle needle 121; a tubular housing 150 regulating the movement of the moving core 122 with a first fixed core 131 provided at one end and a second fixed core 141 provided at the other and receiving the moving core 122, the first fixed core 131 and the second fixed core 141; a first coil 132 for, when energized, magnetizing the first fixed core 131 and thereby attracting the moving core 122 toward a valve opening direction; and a second coil 142 for, when energized, magnetizing the second fixed core 141 and thereby attracting the moving core 122 toward a valve closing direction. When fuel is injected through the nozzle hole part 113, the energizing time of the second coil 142 is made to overlap with the energizing time of the first coil 132 by a predetermined period and the energizing of the second coil 142 is stopped just before the nozzle needle 121 seats on the valve seat 112. This predetermined period is at least 0.2 ms. The timing at which the energizing of the second coil 142 is stopped is made at least 0.1 ms before the nozzle needle 121 seats on the valve seat 112.

That is, when a predetermined fuel injection amount is to be injected through the nozzle hole 113 of the injector 110, the ON time of the closing valve pulse to the second coil 142 for driving the nozzle needle 121 toward the valve closing direction is overlapped with the end of the ON time of the opening valve pulse to the first fixed core 131 for driving the nozzle needle 121 toward the valve opening direction. By this means, the valve closing responsiveness of the nozzle needle 121 is improved. Further, the energizing of the second coil 142 is stopped just before the nozzle needle 121 seats on the valve seat 112. By this means, the operating noise generated when the nozzle needle 121 seats on the valve seat 112 is reduced.

Further, in the electromagnetic fuel injector 110 of the present embodiment, the facing area $\{(\pi/4)\times(DO^2-D1^2)\}$ over which the moving core 122 and the second fixed core 141 abut with each other and the fuel flow passage area $\{(\pi/4)\times(D1^2-D2^2)\}$ downstream thereof are set such that there is a state of fuel compression in the direction in which the nozzle needle 121 seats on the valve seat 112. That is, in the driving of the nozzle needle 121 of the injector 110 toward the valve closing direction, a fuel compression state arises and an oil damper effect is obtained. As a result there is no bouncing when the tip of the nozzle needle 121 seats on the valve seat 112, and a secondary injection to the internal combustion engine through the nozzle hole 113 is suppressed.

What is claimed is:

1. A fuel injector, comprising:

a valve member for opening and closing a fuel injection hole by leaving a valve seat and seating on the valve seat;

a moving core provided integrally with the valve member, the moving core having an annular groove at an outer periphery thereof;

a first fixed core facing one end of the moving core;

a second fixed core facing the other end of the moving core;

a tubular housing surrounding the moving core, the first fixed core, and the second fixed core, the tubular housing being made of magnetic material portions and nonmagnetic material portions disposed alternately in an axial direction, the nonmagnetic material portions being positioned around facing parts of the moving core and the first fixed core, around facing parts of the moving core and the second fixed core, and around the annular groove;

a first coil, mounted at one end of the moving core, for magnetizing the first fixed core when the first coil is energized by an electrical current and attracting the moving core toward a valve opening direction; and a second coil, mounted at the other end of the moving core, for magnetizing the second fixed core and attracting the moving core toward a valve closing direction.

2. A fuel injector according to claim 1, wherein energizing of the second coil is started before an end of energizing of the first coil for holding the valve open, and in a valve-closing stroke, energizing of the second coil is ended before the valve member seats on the valve seat.

3. A fuel injector according to claim 2, wherein the energizing of the second coil is started such that at the end of the energizing of the first coil holding the valve open, an attracting force toward the valve opening direction and an attracting force toward the valve closing direction on the moving core are equal.

4. A fuel injector according to claim 2, wherein the energizing of the second coil is started after the end of the energizing of the first coil holding the valve open.

5. A fuel injector according to claim 2, wherein the energizing of the second coil is started such that the amount of fuel injected from valve-opening to valve-closing is not greater than a predetermined value within a range where the amount of fuel injected is linear.

6. A fuel injector according to claim 2, wherein when fuel is injected through the injection hole, an energizing time of the second coil is controlled to overlap with the end of the energizing time of the first coil by a predetermined period, and the energizing of the second coil is stopped just before the valve member seats on the valve seat.

7. A fuel injector according to claim 6, wherein the predetermined period is at least 0.2 milliseconds.

8. A fuel injector according to claim 6, wherein the timing at which the energizing of the second coil is stopped is at least 0.1 milliseconds before the nozzle needle seats on the valve seat.

9. A fuel injector according to claim 6, wherein a facing area where the moving core and the second fixed core contact with each other and the fuel flow passage area downstream thereof are set such that a state of fuel compression arises in a direction in which the nozzle neddle seats on the valve seat.

10. A fuel injector, comprising:

a valve member for opening and closing a fuel injection hole by leaving a valve seat and seating on the valve seat;

a moving core provided integrally with the valve member;

a first fixed core facing the moving core for attracting the moving core toward a valve opening direction when magnetic flux is supplied;

a second fixed core facing the moving core for attracting the moving core toward a valve closing direction when magnetic flux is supplied;

a first coil mounted at one end of the moving core, for supplying magnetic flux through the first fixed core and the moving core;

a second coil mounted at another end of the moving core, for supplying magnetic flux through the second fixed core and the moving core; and an energizing means for energizing the first and second coils so that the first coil is energized for valve opening, the second coil is energized for valve closing, and after the end of energizing of the first coil, energizing of the second coil is ended before the valve member seats on the valve seat in a valve-closing stroke.

11. A fuel injector according to claim 10, wherein said means for energizing starts energizing of the second coil before an end of energizing of the first coil such that at the end of the energizing of the first coil, an attracting force on the moving core toward the valve opening direction and an attracting force on the moving core toward the valve closing direction are equal.

12. A fuel injector according to claim 10, wherein said means for energizing starts energizing of the second coil after the end of the energizing of the first coil.

13. A fuel injector according to claim 10, wherein said means for energizing starts energizing of the second coil such that the amount of fuel injected from valve-opening to valve-closing is not greater than a predetermined value within a range where the amount of fuel injected is linear.

14. A fuel injector according to claim 10, wherein when fuel is injected through the injection hole, said means for energizing controls an energizing time of the second coil to overlap with the end of the energizing time of the first coil by a predetermined period, and said means for energizing stops the energizing of the second coil just before the valve member seats on the valve seat.

15. A fuel injector according to claim 14, wherein the predetermined period is at least 0.2 milliseconds.

16. A fuel injector according to claim 14, wherein the timing at which the energizing of the second coil is stopped is at least 0.1 milliseconds before the nozzle needle seats on the valve seat.

17. A fuel injector, comprising:

a valve member for opening and closing a fuel injection hole by leaving a valve seat and seating on the valve seat;

a moving core provided integrally with the valve member;

a first fixed core facing the moving core for attracting the moving core toward a valve opening direction when magnetic flux is supplied;

a second fixed core facing the moving core for attracting the moving core toward a valve closing direction when magnetic flux is supplied;

a first coil mounted at one end of the moving core, for supplying magnetic flux through the first fixed core and the moving core; and a second coil mounted at another end of the moving core, for supplying magnetic flux through the second fixed core and the moving core, wherein the moving core provides two magnetic flux paths therein, the paths flowing the magnetic flux generated by the first coil and the magnetic flux generated by the second coil independently.

18. A fuel injector according to claim 17, further comprising a means for providing two independent magnetic flux paths, the first path flowing the magnetic flux generated by the first coil through the first fixed core and a part of the moving core, and the second path flowing the magnetic flux generated by the second coil through the second fixed core and another part of the moving core.

* * * * *